United States Patent [19]

Weigl

[11] 4,009,884

[45] Mar. 1, 1977

[54] BRIDGE GAME

[76] Inventor: William Weigl, 11033 Greenhaven Parkway, Brecksville, Ohio 44141

[22] Filed: Oct. 25, 1973

[21] Appl. No.: 409,640

[52] U.S. Cl. ..... 273/149 P; 35/8 B; 273/152.44; 273/152.2

[51] Int. Cl.[2] ..... A63F 1/00

[58] Field of Search ..... 273/148 R, 149 P, 152.2, 273/152.44; 35/8 B

[56] References Cited

UNITED STATES PATENTS

| | | | |
|---|---|---|---|
| 2,048,954 | 7/1936 | Shokler | 35/8 B |
| 3,013,349 | 12/1961 | Cooper | 273/148 R UX |
| 3,236,524 | 2/1966 | Shook | 273/152.2 |

*Primary Examiner*—Anton O. Oechsle

[57] ABSTRACT

Bridge game for two or three individuals, utilizing a standard, four-suit deck of 52 cards. Prearranged dummy hand is selected without viewing the faces of the cards thereof, and the players are subsequently provided with general information relative to the point count and supporting suits of the dummy hand, from which the strength of the dummy can be combined with that of each bidding player's hand for bidding purposes. If, during bidding, a player bids the Blackwood convention, specific information relative to the number of aces or kings in the dummy hand is also provided. Once bidding is completed, the dummy hand is exposed and play proceeds in the regular fashion of the true game of contract bridge.

12 Claims, 6 Drawing Figures

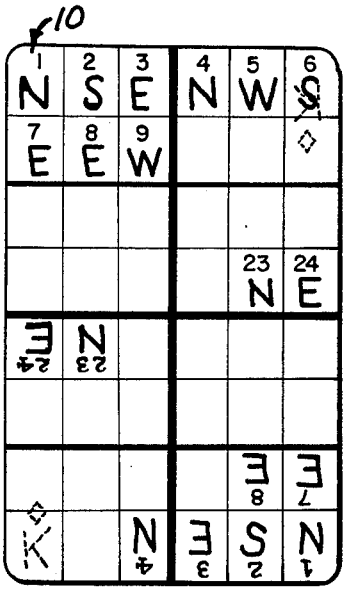
FIG. 1
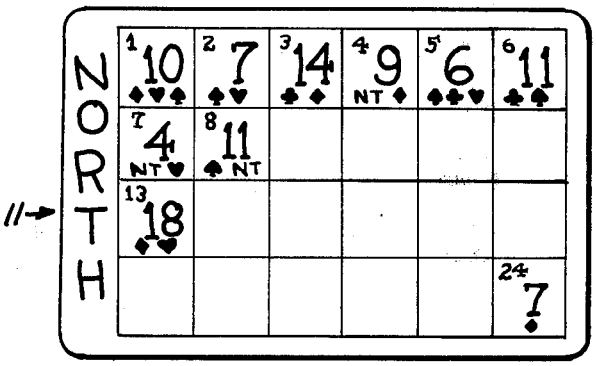
FIG. 2
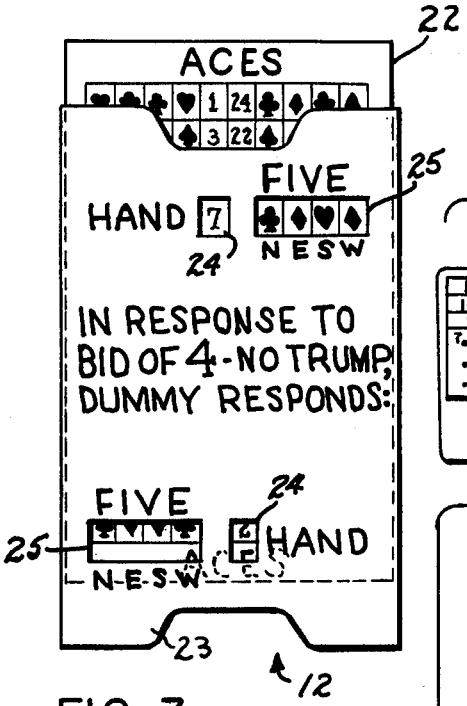
FIG. 3
FIG. 4
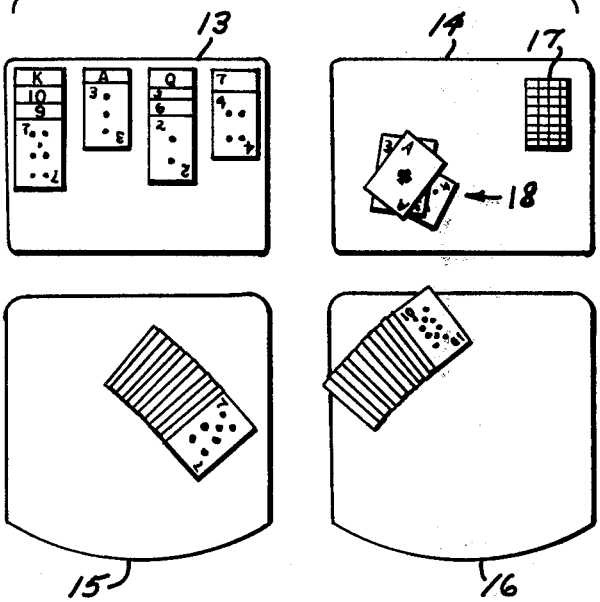

BRIDGE GAME

BACKGROUND OF THE INVENTION

A variety of bridge games for two or three persons have been devised from time to time. The principal ones of these are: (a) "honeymoon bridge", in which two players are each dealt a hand and both draw from the pack after each trick, (b) three-handed "cutthroat", in which each of three players bids for a completely unexposed, uncertain dummy, and (c) a two-handed bridge game wherein each player has a dummy hand in addition to his unexposed hand, the dummy being partially-exposed and partially-unexposed during play of the hand.

In two-handed "honeymoon bridge", thirteen tricks are first played at "No Trump", until the pack is depleted. Thereafter, bidding and play proceeds either at No Trump or at a suit contract. No dummy hand, nor any bidding related to a "point count" system is involved, thus the game only remotely resembles the true four-handed game of contract bridge.

In three-handed "cutthroat", one hand is set aside, face down. Each player bids for the dummy without any indication of its contents. Thus, the final contract is achieved strictly by guesswork, and any relationship between the actual bid and the contract achieved is purely coincidental.

In the two-handed game played with two dummy hands, each player can see his entire hand and approximately half of both his and his opponent's dummy hands. This enables somewhat more accurate bidding than the "cutthroat" game, however, play of the hand is out of the ordinary, in that the unexposed cards of the dummy are turned face-up only as exposed cards are played upon a trick. This prevents effective strategy in capturing the key cards of an opponent.

None of the above-mentioned versions of bridge provides any education regarding the rules of four-handed partnership bidding.

SUMMARY OF THE INVENTION

The invention relates to a method and apparatus for playing two and three-handed bridge, utilizing point count bidding for a predetermined dummy hand, about which general, and sometimes specific, information is provided during bidding. The bidding and play of the game are like the true game of four-handed bridge, thus enabling the game to be used for educational purposes prior to actual learning of the complex partnership bidding rules of the four-handed game.

BRIEF DESCRIPTION OF THE DRAWINGS

FIG. 1 illustrates a playing card of the deck with one type of coding means which may be applied thereto to enable the dealing of prearranged dummy hands.

FIG. 2 illustrates a preferred embodiment of the invention in which one of four different point count cards supplies information indicating the general contents or strength of certain predetermined dummy hands.

FIG. 3 is a view of one side of a "Blackwood" card utilized to provide specific information relative to the number of Aces and Kings in a given dummy hand in response to a bid by one of the bidding players who seeks to contract for a slam bid.

FIG. 4 is a schematic illustration of the positions of two players and a dummy hand when playing side-by-side, for example, as on an airplane.

DESCRIPTION OF THE PREFERRED EMBODIMENT

Figure 5:
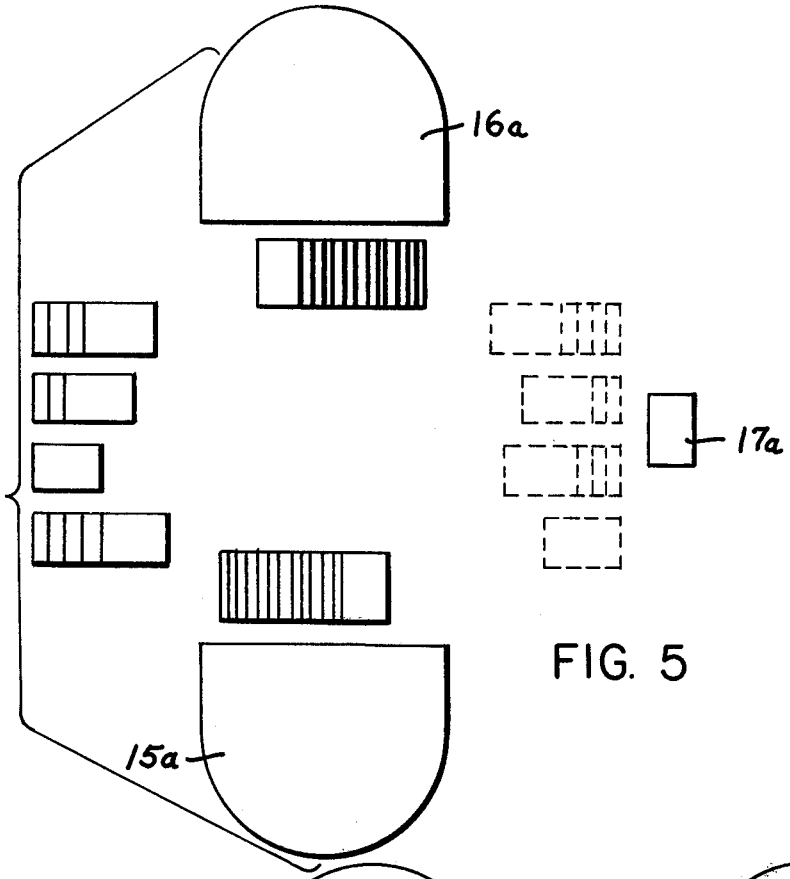
FIG. 5 is a schematic illustration of the position of two players and the dummy hand when playing across a table from one another.

The apparatus used for playing two or three-handed bridge according to my invention includes a standard bridge deck of fifty-two playing cards consisting of the four suits of spades, hearts, diamonds and clubs. Each suit conventionally has thirteen cards, running from the Ace through the King. One such card is shown face down in FIG. 1. Let us assume the card is the King of diamonds, as can be noted from the dotted lines in FIG. 1. Coding means 10 is provided on the back of the card, so that the card can be selected as part of a prearranged dummy hand without viewing the face of the card. The version of the coding means 10 shown in FIG. 1 illustrates indicia designating the hand to be played. These indicia are located in various positions on the back of the card. For example, in the upper left hand corner of the card illustrated, it will be seen that the King of diamonds is part of prearranged hands No. 1 North, 2 South, 3 East, etc. The backs of thirteen cards of the deck will be marked North in the square for dummy hand No. 1, and thirteen each will be designated East, South and West. Any of several techniques for selection of dummy hands by printed coding is possible. Some other known examples are shown and described in U.S. Pat. Nos. 1,418,020; 2,296,113 and 3,519,274. In addition, it is to be understood the game may be provided with other types of coding means, for example, punched holes and slots as in U.S. Pat. No. 834,189, French Patent No. 1,325,858, or U.S. Pat. No. 3,658,342. Also, the cards may be supplied with special information on their backs or even their faces, such as conductive printing of the type illustrated in U.S. Pat. No. 3,222,071. In that patent, electrical sorting techniques may be employed for selecting the dummy hand to be played. Any type of coding means may be utilized, thus, the form shown in FIG. 1 is illustrated primarily for purposes of explanation of the invention.

Supplied with the deck of cards, and preferably the same size as the cards, are a pair of point count cards 11, which contain information that provide a key element of the invention. The card illustrated in FIG. 2 provides general information about all of the prearranged dummy hands which are designated "North" by the coding means 10 on the back of the playing cards. For example, the King of diamonds of FIG. 1 will be part of dummy hand No. 1 North, and it can be seen from the point count card 11, that hand No. 1 North has a point count of ten points and supports the suits of diamonds, spades and hearts. It will be noticed that there are 24 North hands on the point count card shown in FIG. 2. It should be understood that there are similar point count cards for East, South and West, one of which is preferably on the reverse side of the card 11 of FIG. 2. The 24 squares of each point count card corresond to the 24 spaces on each half of the back of the playing card of FIG. 1. For the sake of convenience in selecting the dummy hands, the upper and lower halves of the backs of the cards are inverted duplicates.

FIG. 3 illustrates a Blackwood selector 12, since it provides specific information according to the customary Blackwood Convention which is well understood internationally by bridge players. As will be seen subsequently when describing the bidding of a hand, the Blackwood selector 12 will provide the players with the actual number of Aces and Kings in a given dummy hand in response to bids of "4 No Trump" and "5 No Trump" respectively by one of the players. Such bid enables a player to determine whether the contents of the dummy hand will enable him to contract for a slam bid.

Since the game of contract bridge is so well understood internationally, I will now proceed to describe the bidding and play of the two-handed game utilizing the apparatus and method of my invention.

TWO-HANDED BRIDGE

Players Positioned Side-by-Side

FIG. 4 illustrates play of the game by two players sitting side-by-side at a table or, as shown, in adjacent seats of an airplane, with serving trays 13 and 14 located in front of seats 15 and 16 respectively.

Although it will be seen that this game version provides a large percentage of the interesting features of the true game of contract bridge, for example, accurate point count bidding, finesses, ruffing, cross-trumping, etc., certain arbitrary rules have been instituted in this two-handed version in order to make it as nearly identical as possible to the existing point count systems of bidding and play of the hand. This is done not only to make the game immediately playable with only very slight modifications to persons presently familiar with the game of bridge, but also to provide an excellent teaching tool for beginners who can, for the first time by use of this game, learn to play the game before learning the complex rules of partnership bidding.

In all illustrations to be described, it should be understood that the known Goren point count bidding system is used by way of example, wherein Aces and face cards are given a "high card" point value, and singletons, doubletons and voids in a suit are given "distributional" point value. In addition, especially to help in the teaching aspect of the game, scoring values are identical with the true game of contract bridge. The number of points to make a game in a given suit or at No Trump is exactly the same as that of the known Goren system of bidding. For example, a bid of three No Trump requires a point count of 26 points to score a 100-point game, a bid of "four" in either of the major suits of spades or hearts requires a point count of 26 to make a score of 120, and a bid of "five" requires a point count of twenty-nine, in either of the minor suits of diamonds or clubs to score a game of 100 points. With the foregoing understanding, let us now proceed with a two-handed game according to the player positions of FIG. 4. Initially, a dummy hand (for which both players will bid in the preferred form of the game) is selected without viewing the faces of the playing cards. This is accomplished by utilizing the coding means 10 associated with the cards. For example, if hand No. 1 North is to be played, the deck may be split between the two players, and, by looking at the square on each card which is designated No. 1 N (for North), the two players can select the 13 card dummy hand. This dummy is preferably set aside on one of the trays 13 or 14, and the North point count card 11 is placed atop the dummy. Next, the first dealer deals thirteen cards to each player and sets aside a residue pack 17 of the remaining thirteen cards. (In the three-handed game to be described subsequently in connection with FIG. 6, it is obvious that there will be no residue pack.) The residue pack 17 makes the two-handed game possible and also serves a useful purpose to offset a disadvantage which a defending player has during play of the hand. The defender will be permitted to select a certain number of cards from the pack 17 in exchange for cards to be discarded from his own hand. This desired variation is provided since a defender has no partner with which to seek to set the contract of the declarer.

Now, with each player having his own hand, each can determine the total point count value of his hand combined with that of the dummy. The point count value of the dummy is determined by checking the point count card 11. As shown in FIG. 2, the point count of hand No. 1 North is ten points. The square pertaining to that hand also indicates that the prearranged dummy hand has support for the suits of diamonds, spades and hearts. Assuming that the player in seat 15 has a point count of sixteen, by adding the ten points of the dummy, he will have a total point count of 26, which is known in the Goren system to be adequate to go to game in either No-Trump or a major suit. The player in seat 16 may have twelve points in his hand, totalling 22 points when combined with that of dummy, thus forcing him to discontinue bidding somewhat short of a game contract, unless, of course, he gambles on a long suit, an unusual distribution, etc. As in regular bidding, the dealer bids first. Bidding continues until closed out. At this point, an arbitrary rule is provided. Bidding proceeds until there are two consecutive passes, or until one player passes twice in succession with an intervening bid by the other player. The purpose of this is to reduce to an absolute minimum the number of false bids either player can make to mislead his opponent. For example, if one of the two players has a strong hand and knows from the outset of bidding that he can achieve a game contract, and the other is unable to bid because of a very weak hand, the player with the strong hand is in a position to keep bidding falsely until he finally decides to arrive at the final contract bid. Such a final bid can actually be determined as soon as the point count card 11 is seen. By enabling one player to cut off the bidding by that player passing twice in succession, any player who is unable to bid can force his opponent, after registering a first pass, to arrive at a final bid or else risk having the bidding terminate upon a second "pass" by the non-bidding player. Of course, both players can give false bids so long as both are bidding, but as soon as either registers a pass, the other had better enter his final bid.

In hand No. 1 North, the total point count of ten points may be a combination of both high card points and distributional points. While the two may be specified separately, I have found that doing this provides excessive information about the dummy hand. If distributional points were determined separately of high card points, one could often determine exactly what the distribution is. For example, if the hand contained three distributional points and supported three suits, it is obvious that there is a void in the remaining, unsupported suit. It will be noted from point count card 11 that several hands are stated to also support a No Trump bid. See hand No. 8 North as an illustration. Support of No Trump simply means that each suit contains a stopper, and at least a two-card suit with either an Ace or a King, or a three-card suit at least as high as a Queen. Suit support indicates that there are at least three cards in a given suit at least one of which is as high as a King, or four cards of any value.

Let us assume that the player in seat 15 of FIG. 4 has bid five diamonds, which means that the player is contracting to take a book of six tricks, plus an additional five tricks for the contract. After bidding has ended, the player becomes the declarer and is entitled to examine the dummy hand and prepare it to be arranged on the tray 13 in front of him. At this time, a second arbitrary rule of the game is employed in order to provide the defending player in seat 16 with the benefit of strengthening his hand, due to the disadvantage he has of not having a playing partner. At this point, the residue pack 17 is made accessible to the defender. I have found that entitling the defender to take the top three cards of the residue pack 17 to replace three cards from his hand provides the defender with additional defensive strength to offset the disadvantage of defending without a partner. Without this provision, I have also found that a game contract can be achieved with two or three points less than the average amount required under the Goren system. This selection from the residue pack 17 is used only for the two-handed game, since there is no residue pack when playing three-handed bridge. Neither is there any disadvantage in the three-handed game since there are always two defenders. Thus, the three-card selection enables the two-handed game to be played with the same total point count to achieve a game. This provides a beginner with the proper information with which to graduate to the true four-handed partnership game. Selection from the residue pack 17 is made prior to the laying open of the dummy by the declarer. Once the defender has discarded three cards to the residue pack, play of the hand can commence with an opening lead by the defender.

The sizes of trays on commercial airplanes are quite adequate for laying out the dummy hand. To provide playing room for the tricks 18, I prefer that they be played on the other tray. After the opening lead, play proceeds clockwise if the declarer is in seat 15. It can be seen that a lead from the dummy hand through the defender in seat 16 is toward a closed hand of the declarer. A finesse to a closed hand is advantageous. To give a declarer in seat 16 the same advantage, play is desirably made counterclockwise to give a person in that seat the same advantage, although this is not absolutely essential. Since the players are sitting side-by-side, it is easy to get used to this direction of play, since the players are playing to each other, and not around a table.

Players Positioned Across a Table

FIG. 5 illustrates two-handed play of the game which, for all practical purposes, is much the same as play of the game of FIG. 4, with one exception. Setting aside of the prearranged dummy hand, dealing of the cards, setting aside a residue pack, bidding, draw from the residue pack by the defender, and the opening lead are all the same as described in connection with FIG. 4. The principal difference is that both players have the same advantage regarding finessing toward a closed hand, while always playing tricks in clockwise fashion. This is accomplished by always placing the dummy hand to the declarer's left. If the declarer is in seat 15*a*, the dummy should be located in the solid-line position. If the declarer is in seat 16*a*, the dummy should be located in the dotted-line position.

It should be remembered that the thirteen-card residue pack 17*a* removes one fourth of the cards of the deck from play. All of these cards are unknown to the declarer, and ten are unknown to the defender, since three were discarded from his hand. Clockwise play in FIG. 5 is without disadvantage to either player. However, referring back to FIG. 4, it can be seen that a player in seat 16 cannot place the dummy to his left, thus, by putting the dummy on tray 14 and playing the hand counterclockwise, the finesse results achievable by both players is the same.

Finessing toward a closed hand is desirable, even though it gives the declarer an advantage. Since the thirteen cards of the residue pack 17 or 17*a* are out of play, it sometimes happens that a King or Queen is the highest card of those in play. This may not be known by the defender in protecting against a finesse, and thus adds a novel element to the two-handed game. Of course, if desired, the dummy can always be placed to a declarer's right side, making finesses work only toward the open dummy hand. When playing side-by-side with dummy to the declarer's right, counterclockwise play of tricks should be made when the declarer is in seat 15. This may, in fact, eliminate the need for strengthening the defender's hand from the residue pack, or may reduce the draw therefrom to only two cards to keep the total point count required for game aligned with that of the Goren system of bidding.

THREE-HANDED BRIDGE

Figure 6:
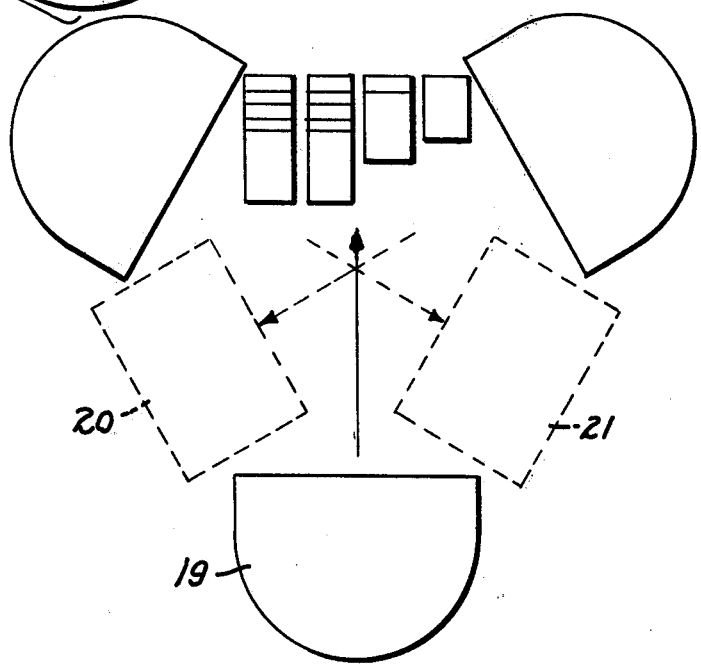
FIG. 6 is a schematic illustration of the positions of players when playing three-handed bridge according to the invention.

FIG. 6 illustrates play by three individuals, preferably located 120° apart around a circular card table. The game is particularly useful where a two-table party of eight individuals is interrupted by failure of one pair of players being unable to play. The remaining six individuals can play two games of three-handed bridge. In three-handed bridge, the predetermined dummy hand will originally be set aside and all players, commencing with the dealer, will bid for the dummy, as in the normal cutthroat game. The point count card will provide the usual general information about the dummy hand. Three successive passes closes out the bidding, after which the declarer positions the dummy directly opposite himself once the defending player to his left makes the opening lead. Also, if desired to minimize false bids, two consecutive passes, a bid and two more consecutive passes can be made to close the bidding.

In FIG. 6, the person in seat 19 is indicated to be the declarer, and locates the dummy hand in the full-line position. If one of the other players becomes the declarer, the dummy hand is placed in one or the other of the dotted-line positions.

BLACKWOOD CONVENTION BIDDING

In addition to the point count cards which provide general information relative to the dummy hand, I also provide, as shown in FIG. 3, certain specific information. The specific information in the illustrated case is that of the well-known Blackwood Convention. If either player bids Four No-Trump he is immediately entitled, without an intervening disruptive bid by any other player (since such is not common in the regular four-handed game), to gain access to the Blackwood selector 12. This selector is otherwise kept out of view of all players at all times, except in response to a Blackwood Convention bid. By operating a slide card 22 either up or down within an encasement 23 until the number of the hand being played appears in one of a pair of windows 24, the responding bid of the dummy at the Five level can be seen in the appropriate one of the windows 25 of encasement 23. This response indicates the number of Aces contained in the dummy hand. As is known, a bid of Five Clubs indicates no Aces, Five diamonds — one Ace, etc. The dummy response in window 25 is in that suit (at the Five level) directly above the hand being played, whether it be North, East, etc.

When the Ace response is determined from the Blackwood selector 12, if the same bidder wishes to continue toward a slam bid, he will immediately bid Five No Trump. Again, he is immediately entitled to turn over the Blackwood selector 12, where Kings are similarly indicated. Preferably, the indicia is so located on both sides of the slide card 22 that card 22 need not be moved within encasement 23 to obtain the King response. The opposite side of the Blackwood card should not be seen unless the appropriate Five No Trump bid is made by a bidding player, which is a desirable reason for placing that information on the reverse side of selector 12 from the Ace information.

I prefer that all cards, those of the deck, the point count cards and Blackwood selector be of the same size for placement in a standard-size card container.

SCORING

When playing two-handed bridge, scoring is identical to the four-handed game, using two columns on the score sheet.

When playing three-handed bridge, three scoring columns are provided, one for each player. Scores are identical to the regular game, except that when two defenders set a contract, they each place the full setting score in their respective columns. Since defenders are teamed differently from hand to hand, players can score offensively for themselves or defensively with one or the other of the remaining two players.

DUPLICATE BRIDGE

Because I am able to set aside prearranged thirteen-card hands, obviously the game is also adapted for two, three or four-handed duplicate bridge. Thus, couples can now play two-handed duplicate, record the scores for a period of time, reverse the order of who holds which hand, and replay them at a later date.

GENERAL

While the games have been described with all players bidding, if desired, bidding may be limited to one player only.

Another interesting approach to bidding is to require a round of bidding to precede a look at the point count card. Thus, a player is more likely to bid his best suit, just in case he is awarded a dummy with only a very few points. The point count of the cards 11 can be made to appear through windows similar to those of the Blackwood selector 12.

In the version of cards illustrated in FIG. 1, there are four dummy hands within each of twenty four squares, thus totalling 96 dummy hands in all. However, if hole and slot coding or magnetic ink coding is utilized, the number of prearranged dummy hands possible from a single deck can run into several hundreds. Since the hands other than the dummy are mixed and dealt at random, a single deck can be useful for a long period. Also, this kind of game is conducive to continued production of different decks with different prearranged dummy hands.

If the game is to be restricted to non-duplicate play, the coding can be made to select only one dummy hand from a given location, doing away with the North, East, South and West designations. When playing with the latter designations, it is suggested that several hands be played from the same point count card if bidding proceeds with the point count card immediately exposed. However, if the card is to be viewed only after an initial bid by each player, then the cards should be used alternately, although two consecutive hands should never be of the same number hand.

Instead of the cards 11, the general information may be contained in any manner, including a mere printed, folded sheet.

Other information of either a general or specific nature may be provided without departing from the spirit and scope of my invention, to enable accurate point count bidding and playing the true game of dummy bridge by two or three players.

Having described my invention, I claim:

1. In a contract bridge game for play by two or three players, wherein an unexposed predetermined thirteen-card dummy hand is preliminarily established at each hand played for bidding thereon by at least one of said players and thereafter thirteen cards are dealt to each player, a standard four-suit bridge deck of fifty-two cards, coding means associated with the cards of said deck for selecting, without viewing the faces thereof, a plurality of different predetermined dummy hands from said deck, and means associated with the faces of the cards of each different predetermined dummy hand of said deck for indicating the general strength without revealing the specific contents of each predetermined dummy hand to provide at least each bidding player with an approximate indication of the combined strength of his specific hand and a given unexposed predetermined dummy hand, as a basis from which each bidding player may contract for the number of individual tricks such bidding player expects to take subsequently upon laying open said dummy hand and actually playing a game.

2. A bridge game according to claim 1 wherein said means associated with said faces includes point count information relative to an established point count system indicating the approximate strength of said dummy hand.

3. A bridge game according to claim 1 wherein said means associated with said faces includes information relative to the card suit or suits supported by said dummy hand.

4. A bridge game according to claim 2 wherein said means associated with said faces also includes further information relative to the card suit or suits supported by said dummy hand.

5. A bridge game according to claim 1 including second means associated with said faces for providing at least one artifical bid by said unexposed dummy hand in response to a given bid by a bidding player, said artificial bid providing information regarding said dummy hand which is more specific in nature than the general strength indicated by the other means associated with said faces.

6. A bridge game according to claim 5 wherein said second means provides information relative to the number of aces contained in said dummy hand.

7. A contract bridge game for play by two players, wherein an unexposed predetermined 13 card dummy hand is preliminarily established at each hand played for bidding thereon by at least one of said players, wherein each player is thereafter dealt a 13 card hand and the remaining 13 cards are set aside, out-of-play, comprising, a standard four-suit bridge deck of fifty-two cards, coding means associated with the cards of said deck for selecting, without viewing the faces thereof, a plurality of different predetermined dummy hands from said deck, and means associated with the faces of the cards of each different predetermined dummy hand of said deck for indicating the general strength without revealing the specific contents of each predetermined dummy hand to provide at least each bidding player with an approximate indication of the combined strength of his specific hand and a given unexposed predetermined dummy hand, as a basis from which each bidding player may contract for the number of individual tricks such bidding player expects to take subsequently upon laying open said dummy hand and actually playing a game.

8. A bridge game according to claim 7 wherein said means associated with said faces includes point count information relative to an established point count system and further information regarding the card suit or suits supported by said dummy hand.

9. A bridge game according to claim 7 including second means associated with said deck for providing an artificial bid by said unexposed dummy in response to a bid by a bidding player calling for the number of aces held by said dummy hand, said artificial bid providing the answer called for by said bid.

10. The method of playing a two-handed bridge game utilizing a standard four-suit bridge deck of fifty-two cards, comprising the steps of, selecting from said deck, without viewing the faces of the cards thereof, a predetermined thirteen-card dummy hand in accordance with an established coding system associated with said cards, dealing a thirteen-card hand to each player and setting aside the remaining thirteen cards, making available to at least one of said players general, but not specific, information relative to the approximate contents of said predetermined dummy hand while said hand remains unexposed, contract bidding for said dummy hand by each bidding player combining the specific strength of his hand with the approximate strength of said unexposed dummy hand, exposing said dummy hand by laying it open opposite the bidder to whom the dummy is awarded upon completion of bidding, and playing said hand in accordance with the established rules of bridge.

11. The method according to claim 10 wherein said general information includes point count information relative to an established point count system.

12. The method of claim 11 including the additional step of artificially bidding, from preestablished information, by said dummy hand in response to a bid by a bidding player calling for the number of aces in said dummy hand, said artificial bid indicating the quantity of aces contained therein.

* * * * *